US012487004B2

(12) United States Patent
McCarthy et al.

(10) Patent No.: US 12,487,004 B2
(45) Date of Patent: Dec. 2, 2025

(54) INTERCHANGEABLE DUCT SEAL

(71) Applicant: NTI Global, Amsterdam, NY (US)

(72) Inventors: Rachal McCarthy, Frisco, TX (US); Sarek Raeburn, Little Elm, TX (US); Benal Raeburn, Aubrey, TX (US)

(73) Assignee: NTI GLOBAL, Amsterdam, NY (US)

( * ) Notice: Subject to any disclaimer, the term of this patent is extended or adjusted under 35 U.S.C. 154(b) by 492 days.

(21) Appl. No.: 17/993,593

(22) Filed: Nov. 23, 2022

(65) Prior Publication Data

US 2024/0167721 A1 May 23, 2024

(51) Int. Cl.

| | |
|---|---|
| ***F24F 13/02*** | (2006.01) |
| ***F24F 1/03*** | (2019.01) |
| ***F24F 7/00*** | (2021.01) |

(52) U.S. Cl.

CPC ..... *F24F 13/02* (2013.01)

(58) Field of Classification Search

CPC .... F24F 13/02; F24F 13/0209; F24F 13/0218; F24F 13/0272; F24F 13/0254; F24F 7/04; F24F 7/00

See application file for complete search history.

(56) References Cited

U.S. PATENT DOCUMENTS

| | | | | |
|---|---|---|---|---|
| 937,816 | A | 10/1909 | Koerner | |
| 4,867,232 | A * | 9/1989 | Dewill | F24F 13/10 251/162 |
| 6,564,512 | B1 * | 5/2003 | Whittemore | B08B 15/00 52/127.2 |
| 6,604,993 | B1 * | 8/2003 | Boniface | F24F 7/007 454/186 |
| 11,131,477 | B2 * | 9/2021 | McCarthy | F24F 13/0218 |
| 2005/0003754 | A1 * | 1/2005 | Pilger | F24F 13/02 454/292 |
| 2009/0221226 | A1 | 9/2009 | Gebke et al. | |
| 2010/0197214 | A1 | 8/2010 | Geremia, Sr. et al. | |
| 2011/0000569 | A1 | 1/2011 | Lynch et al. | |
| 2013/0088833 | A1 | 4/2013 | Cox et al. | |
| 2015/0075109 | A1 | 3/2015 | Bergevin et al. | |
| 2016/0312525 | A1 | 10/2016 | Valinejadshoubi et al. | |

(Continued)

FOREIGN PATENT DOCUMENTS

| | | | | |
|---|---|---|---|---|
| CN | 104453580 | A | 3/2015 | |
| CN | 112065246 | A | 12/2020 | |
| KR | 20160060613 | A * | 5/2016 | F24F 13/02 |

OTHER PUBLICATIONS

English translation of KR 20160060613 by PE2E Feb. 28, 2025.*

(Continued)

*Primary Examiner* — Deming Wan

(74) *Attorney, Agent, or Firm* — Schmeiser, Olsen & Watts, LLP

(57) ABSTRACT

An interchangeable duct seal is provided. The interchangeable duct seal includes a first panel, the first panel having a first support structure and a first material attached to the first support structure; and a brace configured for securing the first panel to a structure; wherein the first panel includes a first opening and is configured to connect to a first duct and/or allow the first duct to pass through the interchangeable duct seal. The interchangeable duct seal may also include a second panel or multiple panels. Related kits and methods are also provided.

11 Claims, 15 Drawing Sheets

(56) References Cited

U.S. PATENT DOCUMENTS

2019/0048649 A1 2/2019 Koenitz

OTHER PUBLICATIONS

Boqon Portable AC Window Seal Kit Adjustable Air Conditioner Window Vent Kit, No Drilling, Waterproof, Easy to Install with Zip and Adhesive Fastener (25×56~92cm). Boqon. https://www.amazon.com/dp/B09V9PHF8J/ref=syn_sd_onsite_desktop_226?pd_rd_plhdr=t&spLa-ZW5jcnlwdGVkUXVhbGlmaWVyPUEzTUFRRjBJOEE3UkRDJmVuY3J5CHRIZEIKPUEwMDk2NDM4MIE5MKJYUTVXS0E1NSZIbmNyeXB0ZWRBZEIKPUEwNjY3MDK3TDJPUE5EN1ICMKFZJndpZGdldE5hbWU9c2*

Hasan, Afzal. Patentability Search Report for "Flexible Ducting System", dated Jun, 2, 2022.*

* cited by examiner

INTERCHANGEABLE DUCT SEAL

FIELD OF TECHNOLOGY

The subject matter disclosed herein relates generally to interchangeable duct seals. More particularly, the present disclosure concerns devices, systems, kits, and methods for providing and sealing ducting in existing structures.

BACKGROUND

Flexible ducting is used for a wide range of blowers, fans, and other ventilating equipment to provide fresh air or other fluids/materials.

Applicant previously disclosed embodiments of a connector for flexible duct and a flexible duct with interchangeable end, as well as related methods, in U.S. application Ser. No. 15/922,225, filed on Mar. 15, 2018, now U.S. Pat. No. 11,131,477, issued on Sep. 28, 2021, the entire contents of which are hereby incorporated by reference.

Many times, ducting must be adapted to existing structures. As an example, temporary ducting may be provided during construction, during an emergency, during a power outage, or at other times. The ducting may be used to provide fresh air, temperature control, humidity control, air conditioning, heating, and the like. Further, the ducting may be used to vent/exhaust unwanted air, chemicals, fumes, smoke, heat, cold, etc. from the structure. The following provides devices, systems, kits, and methods related to how ducting may be applied to windows, doors, docks (e.g. loading docks used for truck delivery and shipping), and the like. The devices, systems, and methods provide for rapid attachment, sealing, and release of the ducting to entryways to a building, tent, or other structure, for example, windows, doors, dock doors, and the like.

Improved devices, systems, kits, and methods for attaching and sealing ducting to a structure would be well received in the art.

SUMMARY

According to one embodiment, an interchangeable duct seal comprises a first panel, the first panel having a first support structure and a first material attached to the first support structure; and a brace configured for securing the first panel to a structure; wherein the first panel includes a first opening and is configured to connect to a first duct and/or allow the first duct to pass through the interchangeable duct seal.

According to another embodiment, an interchangeable duct seal comprises a first panel, the first panel having a first support structure and a first material attached to the first support structure; a second panel, the second panel having a second support structure and a second material attached to the second support structure; and a brace configured for securing the first panel and/or the second panel to a structure, wherein the brace includes a channel configured to receive a dock door; wherein the first panel and the second panel are connected by a connection; and wherein the first panel and/or the second panel include an opening and is configured to connect to a duct and/or allow the duct to pass through the interchangeable duct seal.

According to another embodiment, a method of providing ducting for an entryway of a structure comprises positioning a first panel within the entryway, wherein the first panel includes a first support structure and a first material attached to the first support structure; securing the first panel to the structure using a brace such that the first panel seals the entryway; and connecting a first duct to the first panel and/or passing a first duct through the first panel.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures.

Figure 1:
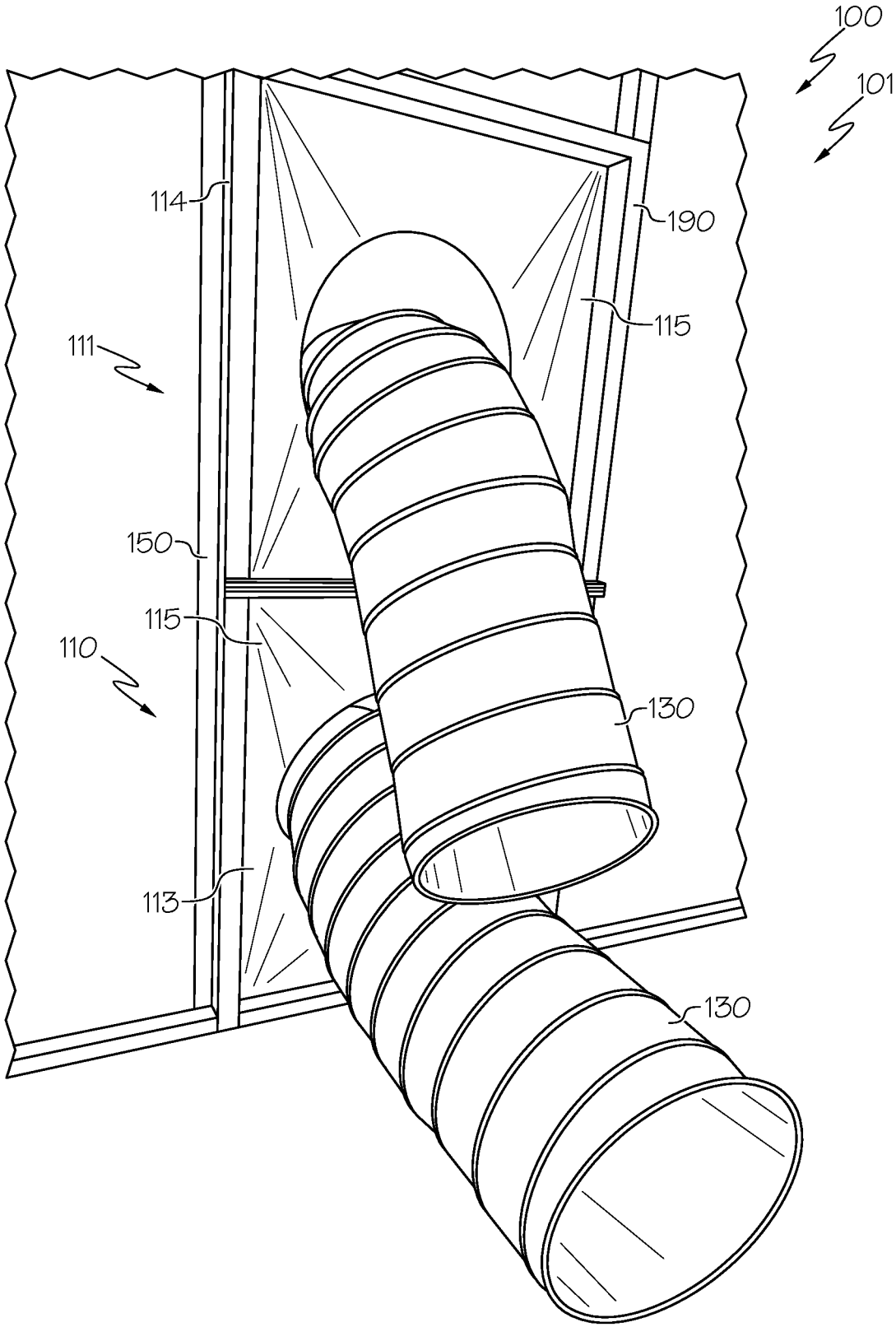
FIG. 1 depicts an interior side of an interchangeable duct seal in accordance with embodiments of the invention.
Figure 2:
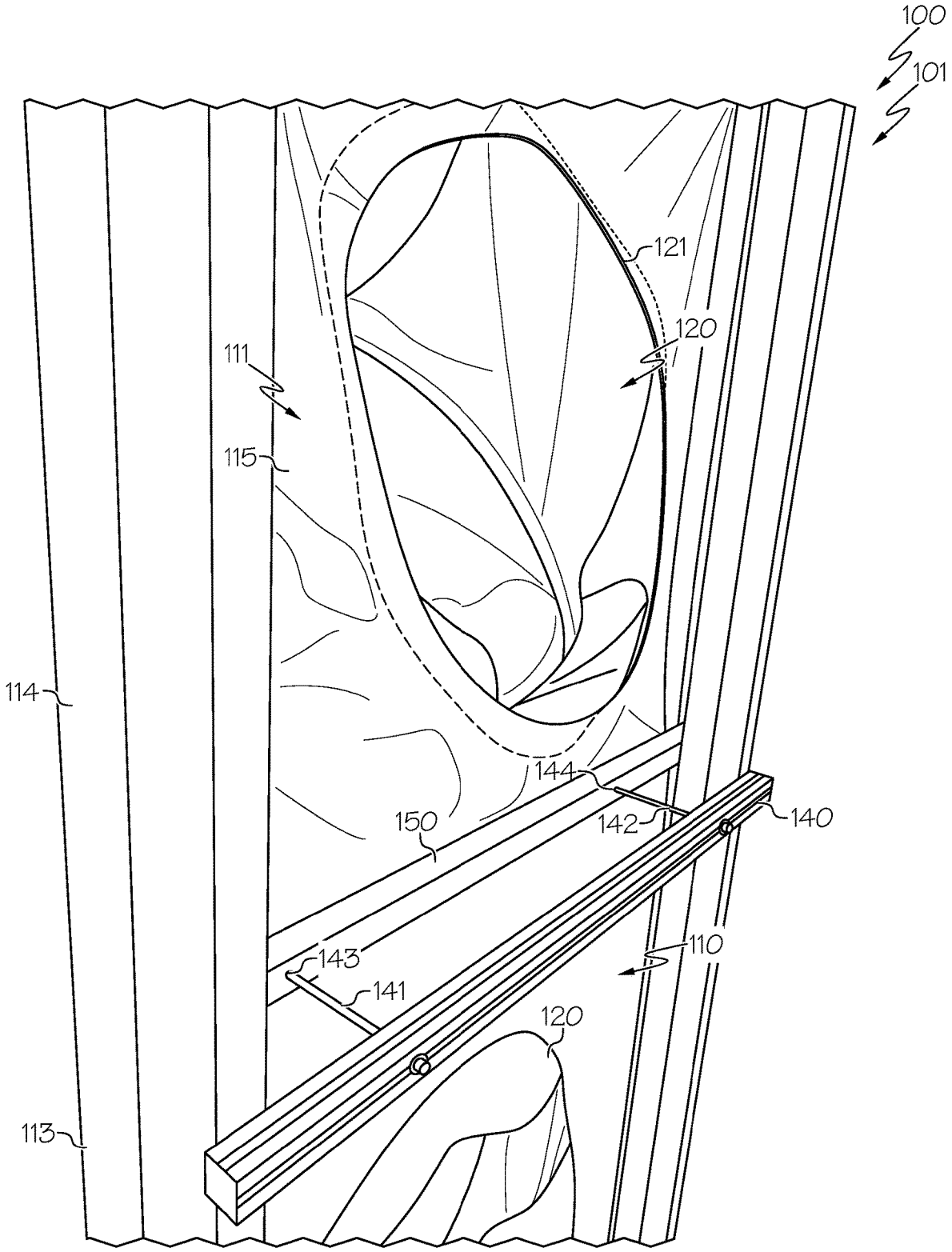
FIG. 2 depicts a close up view of an opening of the interchangeable duct seal of FIG. 1 in accordance with embodiments of the invention.
Figure 3:
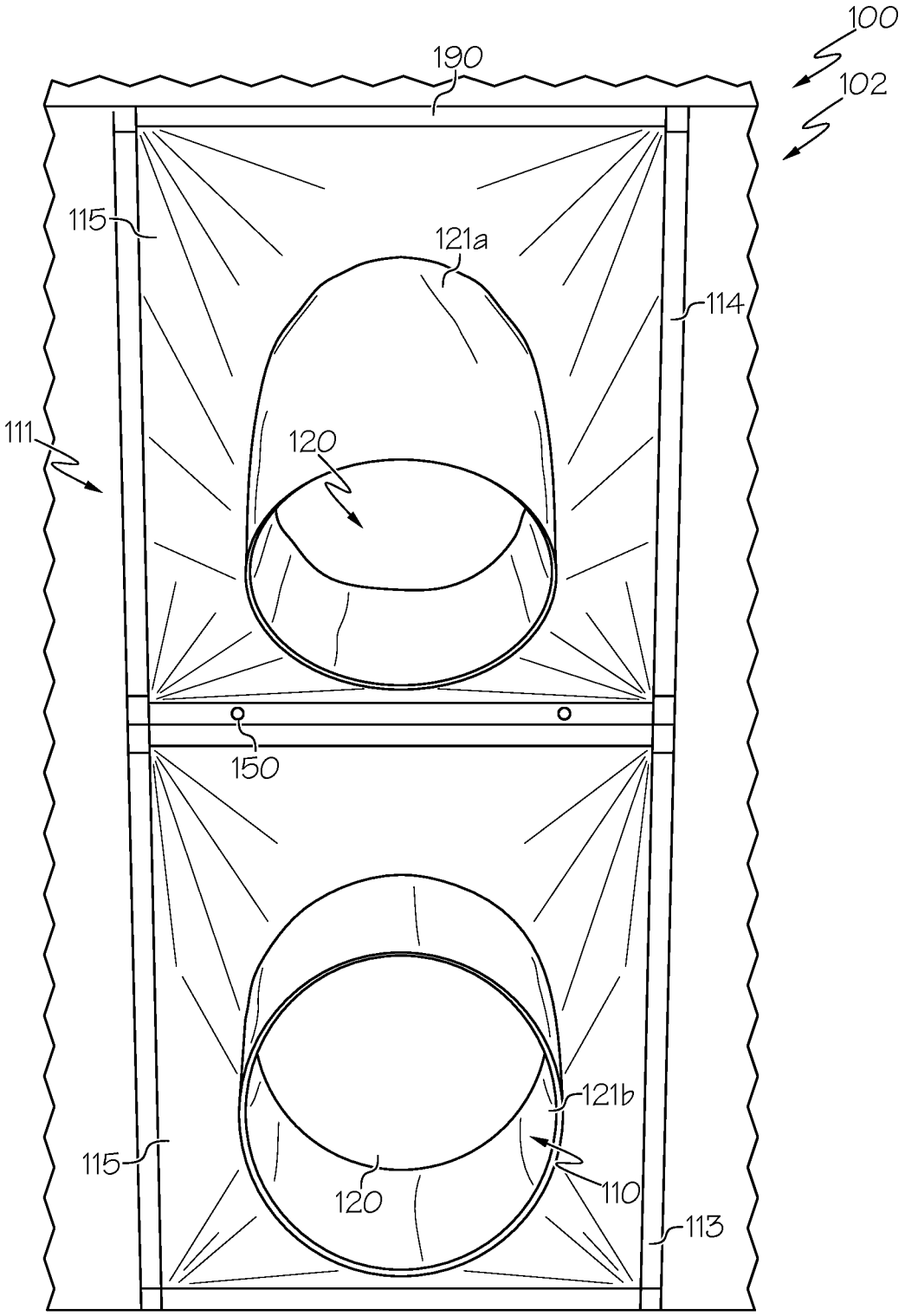
FIG. 3 depicts an exterior side of the interchangeable duct seal of FIGS. 1 and 2 in accordance with embodiments of the invention.

Referring first to FIGS. 1-3, an interchangeable duct seal 100 is shown in accordance with embodiments of the invention. The interchangeable duct seal 100 may be used to provide a flow of air, fluid, and the like, into an area, such as a building, tent, or structure, through an entryway such as a door entryway, window entryway, dock entryway, and the like. The recited entryways are, for example, existing openings in the building, tent, or structure, and thus may provide convenient locations for ducting; however, it will be understood that the embodiments of the invention are not limited to such existing openings and may use other existing openings and/or newly created openings.

An interior side 101 of the interchangeable duct seal 100 is shown in FIG. 1 as well as in the close up view of FIG. 2, while an exterior side 102 of the interchangeable duct seal 100 is shown in FIG. 3. It will be understood that the interior side 101 and the exterior side 102 are designated for convenience in understanding the Figures and are not intended to limit the scope of the subject matter. For example, it will be understood that features shown with respect to the interior side 101 of the interchangeable duct seal 100 may apply additionally or alternatively to the exterior side 102 of the interchangeable duct seal and vice versa.

Referring still to FIGS. 1-3, the interchangeable duct seal 100 comprises one or more panels, for example, a first panel 110 and a second panel 111 as shown in FIG. 1. The first panel 110 and second panel 111 may generally comprise a rectangular shape defined by a support structure, such as a first support structure 113 and a second support structure 114 as shown in FIG. 1. In some embodiments, other shapes may be used for the first panel 110, the second panel 111, and/or additional panels. The first support structure 113 and the second support structure 114 may be made of a rigid or semi-rigid material, for example, metal, wood, plastic, composite, and the like. In some embodiments, aluminum or other material having a high strength to weight ratio may be chosen. The support structures may comprise or be referred to as a frame for example. In further embodiments, a thermoformed material may be used, for example, a thermoformed plastic, a thermoformed sheet, or the like. In these embodiments, the support structures may comprise or be referred to as a seal, a seal structure, and the like.

Use of two panels may provide an interchangeable duct seal generally configured for a doorway or similar entryway while use of a single panel may provide an interchangeable duct seal generally configured for a small entryway, such as a window or similar entryway. It will be understood that the number of panels may be varied and that individual panels or sets of panels may be dimensioned to fit a variety of entryways.

The support structure such as the first support structure 113 and/or the second support structure 114 may seal or substantially seal the entryway. For example, airflow through the entryway may be prevented or substantially prevented, particularly airflow around the panel. Still further, the support structure may ensure that the entryway remains open, for example, preventing the window, door, etc. from closing.

Turning again to the embodiment depicted in FIG. 1, the first panel 110 and/or the second panel 111 comprise a material 115 within the first support structure 113 and/or the second support structure 114. The material 115 provides a barrier that substantially prevents passage of air. For example, the material 115 may be formed of fabric material, a plastic material, a composite material, and the like. The material 115 may be synthetic, natural, or a mix thereof. In embodiments, the material 115 may be the same in the first panel 110 and the second panel 111; however, this is not required and different materials may be used, for example a first material in the first panel 110 and a second material in the second panel 111.

Further, one or more of the first panel 110, the second panel 111, and/or additional panels comprise an opening 120 in the material 115. The opening 120 may be configured to receive a duct 130 and/or to connect to or mate with an end of the duct 130. In embodiments, the duct 130 may be conventional duct and/or may be a flexible duct with interchangeable end, as described in Applicant's prior disclosure in U.S. application Ser. No. 15/922,225, filed on Mar. 15, 2018, now U.S. Pat. No. 11,131,477, issued on Sep. 28, 2021, incorporated by reference above. As shown in FIG. 1, the duct 130 may pass through the first panel 110 or second panel 111 by passing through the respective opening 120 in the material 115. Alternatively, the end of the duct 130 may connect to or mate with the panel 115 as is discussed in more detail below.

The opening 120 may provide passage of air through the first panel 110 or second panel 111 and thus through the interchangeable duct seal 100. Air may be provided to the building or structure (intake) or may be removed from the building or structure (exhaust). Further, in embodiments using multiple openings 120, the interchangeable duct seal 100 may provide for both intake and exhaust. It will be understood that any type of air or fluid may be provided, either as intake or exhaust. For example, the interchangeable duct seal may be used to provide temperature control, humidity control, air conditioning, heating, cooling, and the like. Still further, chemicals, fumes, smoke, and the like may be removed by exhausting air through the interchangeable duct seal 100 and/or providing fresh air intake through the interchangeable duct seal 100.

A close up view of the opening 120 (with respect to the interior side 101) is provided in FIG. 2. As shown, the opening 120 may include a protrusion 125 extending from the opening 120 on the interior side 101. The protrusion 125 may help maintain proper sealing around the duct 130 or facilitate attachment of the duct 130. Alternatively, the opening 120 may include features that allow for connection or mating of the duct 130 as described in more detail below.

Referring specifically to FIG. 3, the opening 120 in the material 115 may include a cuff connector 121 on the exterior side 102. Similar to the protrusion 125, the cuff connector 121 may help maintain proper sealing around the duct 130 or facilitate attachment of the duct 130. In embodiments, the cuff connector 121 may comprise, or be similar to, a connector such as that discussed in Applicant's prior disclosure in U.S. application Ser. No. 15/922,225, filed on Mar. 15, 2018, now U.S. Pat. No. 11,131,477, issued on Sep. 28, 2021, incorporated by reference above. For example, the cuff connector 121 may comprise or be similar to a connector such as that shown in FIG. 21 of U.S. Pat. No. 11,131,477 or may include features thereof, including but not limited to a first attachment and a second attachment. For example, the cuff connector 121 may have multiple attachment means for securing a duct end thereto. In embodiments, each cuff connector 121 may include a rigid hoop attachment as well as a strap and buckle attachment. In this way, the cuff connector 121 may be attached to an end of the duct 130 by the strap and buckle attachment or by the rigid hoop attachment. Additional or alternative types of attachment may be used in some embodiments, for example the first attachment and/or the second attachment may include a cinch closure attachment or other attachment. The first attachment and the second attachment can be used independently of each other. For example, the rigid hoop attachment may be used by folding the cuff connector 121 backwards into itself to position the rigid hoop attachment at an end of the cuff connector 121. With reference to FIG. 3, upper cuff connector 121*a* is depicted in a configuration for using the strap and buckle attachment while lower cuff connector 121*b* is depicted in a configuration for using the rigid hoop attachment.

At times, the cuff connector 121 may not be connected to a duct and/or may not be in use. The cuff connector 121 may be closed, for example, may be cinched closed or may be closed using an additional closing feature. Thus, the cuff connector 121 may block or prohibit air flow through the respective opening 120.

It will be understood that the cuff connector 121 could alternatively be positioned on the interior side 101 of the interchangeable duct seal 100 in some embodiments. In such embodiments, the protrusion 125 may be positioned on the exterior side 102. Still further, in some embodiments, the interchangeable duct seal 100 may have a cuff connector 121 on both the interior side 101 and the exterior side 102, either as part of different openings 120 or as part of the same opening 120 and/or may have protrusions 125 on both the interior side 101 and the exterior side 102, either as part of different openings 120 or as part of the same opening 120.

In still further embodiments, one or both of the interior side 101 and the exterior side 102 may include additional or alternative features that allow for connection or mating of the duct 130. For example, the protrusion 125 or a different feature proximate the opening 120 may be configured as an attachment point for a connector and/or for a flexible duct with interchangeable end such as those discussed in Applicant's prior disclosure in U.S. application Ser. No. 15/922,225, filed on Mar. 15, 2018, now U.S. Pat. No. 11,131,477, issued on Sep. 28, 2021, incorporated by reference above. Likewise, the protrusion 125 or a different feature proximate the opening 120 may be configured as an attachment point for other conventional duct connecting/attaching means.

In embodiments, the protrusion 125, cuff connector 121, or other features may be integrally formed with the material 115. Alternatively, the protrusion 125, cuff connector 121, or other features may be attached to the material 115, for example, by sewing, stitching, gluing, taping, welding, brazing, clamping, etc. or by using cleats, clips, etc.

In the case of a two-panel interchangeable duct seal such as that depicted in FIGS. 1-3, the first panel 110 may be detachably attached to the second panel 111. Further, in embodiments, the first panel 110 may be hingedly attached to the second panel 111 such that the panels can be folded against one another. For example, in the embodiment depicted in FIG. 1, the first panel 110 is connected to the second panel 111 by a connection 150. More specifically, as depicted the first support structure 113 may be connected to the second support structure 114 by the connection 150.

In some embodiments, the connection 150 may be a bracket, for example, a bolt-on bracket or similar device. The connection 150 may extend to, or otherwise span, two panels and/or two support structures, and be bolted onto each respective panel or support structure. Thus, a bolted connection between respective panels/support structures may be achieved. Other connection means may also be used, for example, connections using screws, nails, and other types of fasteners.

The connection 150 may allow the interchangeable duct seal 100 to be deployed in several different, interchangeable configurations, for example, by the first panel 110 fitted to and sealing a small entryway such as a window entryway, by the first panel 110 and second panel 111 connected to each other and fitted to and sealing a larger entryway such as door entryway 190 depicted in FIGS. 1 and 3, or by multiple connected panels fitted to and sealing an even larger entryway.

Still further, in embodiments wherein the connection 150 is a hinged connection, the hinged connection 150 may allow the interchangeable duct seal 100 to be optionally folded in half to fit against and seal the small entry way such as the window entryway or securably unfolded (providing an area twice as large) to fit against and seal the doorway 190. In embodiments wherein the interchangeable duct seal 100 comprises two panels folded together, an opening 120 of the first panel 110 may substantially align with an opening 120 of the second panel 111 to provide a single opening through the interchangeable duct seal 100.

While FIGS. 1 and 3 show the first panel 110 and the second panel as substantially identical, this is not required. In some embodiments, the panels may be different. For example, the panels may comprise support structures of different material, material 115 may be different, the openings 120 may be different, etc.

While FIGS. 1 and 3 show the first panel 110 and the second panel 111 connected vertically (the first panel 110 under the second panel 111), it will be understood that the panels may be connected to each other in a horizontal or side by side manner. Still further, a combination of vertical and horizontal connections may be used. For example, as a further embodiment, two or more panels may be stacked vertically with each panel also connected horizontally to a further panel. Thus, as an example, a 2 by 2 arrangement of panels may be formed. It will be understood that any number of additional panels may be so connected, and that uniform numbers of panels would not be required in the vertical and horizontal directions. For example, two vertical panels may be used, with one (or both) of the vertical panels connected horizontally to a single additional panel. Again, any number of panels may be connected in any orientation or arrangement. The use of detachable panels and/or folding panels may allow for more convenient transport, installation, and removal as well as adaptability to a wide variety of different entryways and structures.

The interchangeable duct seal 100 further comprises a brace 140. The brace 140 may be a bar, rod, or similar structure configured to securably attach the panel or panels to the respective entryway. For example, in the embodiment depicted in FIGS. 1-3, the brace 140 is configured to securably attach the panel or panels proximate the connection 150. Other locations and/or positions may be used. Still further, multiple braces 140 may be used, for example, for added strength in the attachment and/or for attaching a plurality of panels.

In the embodiments depicted in FIGS. 1-3, the brace 140 is securely attached by threaded rods 141, 142 extending through corresponding holes 143, 144 in the connection 150. It will be understood that varying number of threaded rods and corresponding holes may be used. Further, one or more of the corresponding holes may be provided in the first support structure 113, the second support structure 114, or both the first support structure 113 and second support structure 114, instead of at the connection 150. The threaded rods 141, 142 secure the brace 140 to existing structure of the doorway 190, or to existing structure of the window, the dock, and the like. The brace 140 allows attachment to various thicknesses and designs of door, window, and dock entryways.

When sealing an entryway such as the door entryway, window entryway, or dock entryway, the first panel 110 and/or second panel 111 can be positioned up against one side of the door entryway, window entryway, or dock entryway, and the brace 140 can be positioned on the other side of the entryway. Within the entryway, the threaded rods 141, 142 of the brace 140 extend through the respective support structure or support structure 113,114 and can be tightened to secure the respective support structure or support structure 113, 114 (and therefore the respective panel or panels 110, 111) and the brace 140 together to form a seal of door entryway, window entryway, or dock entryway. While threaded rods 141, 142 are depicted in FIGS. 1-3, it will be understood that various other attachment/tightening means may be used.

Once attached (or even before attachment) one or more ducts 130 can be positioned through or attached to the respective openings 120 to circulate air into and out of the area, i.e., the building, tent, or structure, through the entryway, while otherwise maintaining a sealed nature of the entryway.

FIGS. 1-3 depict a two-panel interchangeable duct seal. As discussed above, it will be understood that in some embodiments the interchangeable duct seal may use a single panel and/or a single support structure. Thus, instead of folding to fit a small entryway such as a window or similarly-sized entryway, the interchangeable duct seal may be configured for that size. Still further, additional panels may be included such that the interchangeable duct seal uses three or more panels. For example, a three-panel apparatus may be used to provide a seal of the dock entryway or a similarly sized entryway that would be too large for a two-panel interchangeable duct seal. Still further, it will be understood the panels may be dimensioned to fit a respective entryway.

Turning to FIGS. 4-14 an interchangeable duct seal 400 is shown in accordance with further embodiments of the invention. Like the interchangeable duct seal 100 discussed above, the interchangeable duct seal 400 may be used to provide a flow of air, fluid, or other material, into an area, such as a building, tent, or structure through an entryway or other feature. In embodiments, the interchangeable duct seal 400 may be particularly applicable to a dock door. The features of the interchangeable duct seal 400 may be similar to or identical to features of the interchangeable duct seal 100 and it will be understood that the teachings of one embodiment may be applied to the other embodiment and vice versa.

Figure 4:
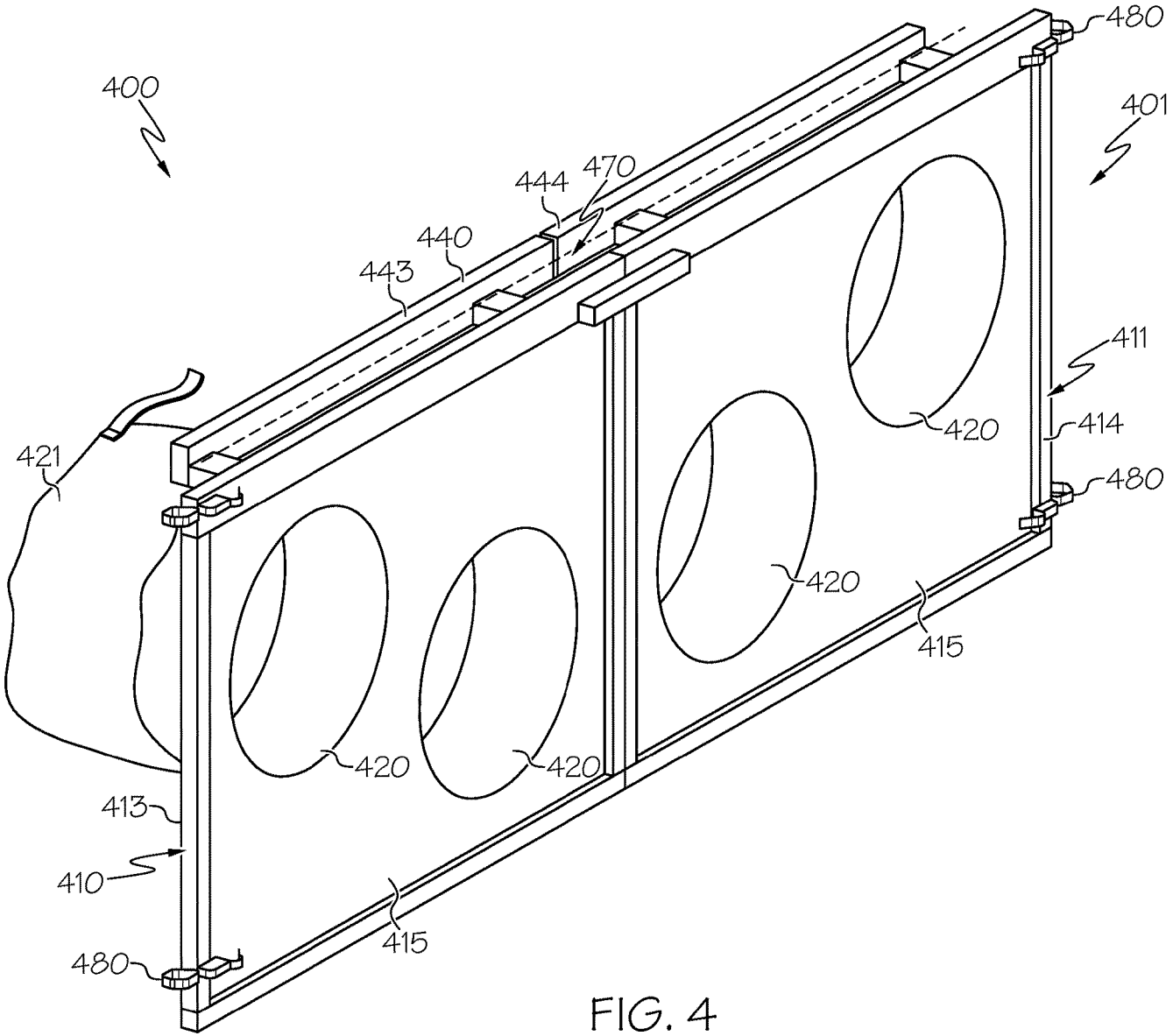
FIG. 4 depicts an interior side of an interchangeable duct seal in accordance with further embodiments of the invention.
Figure 5:
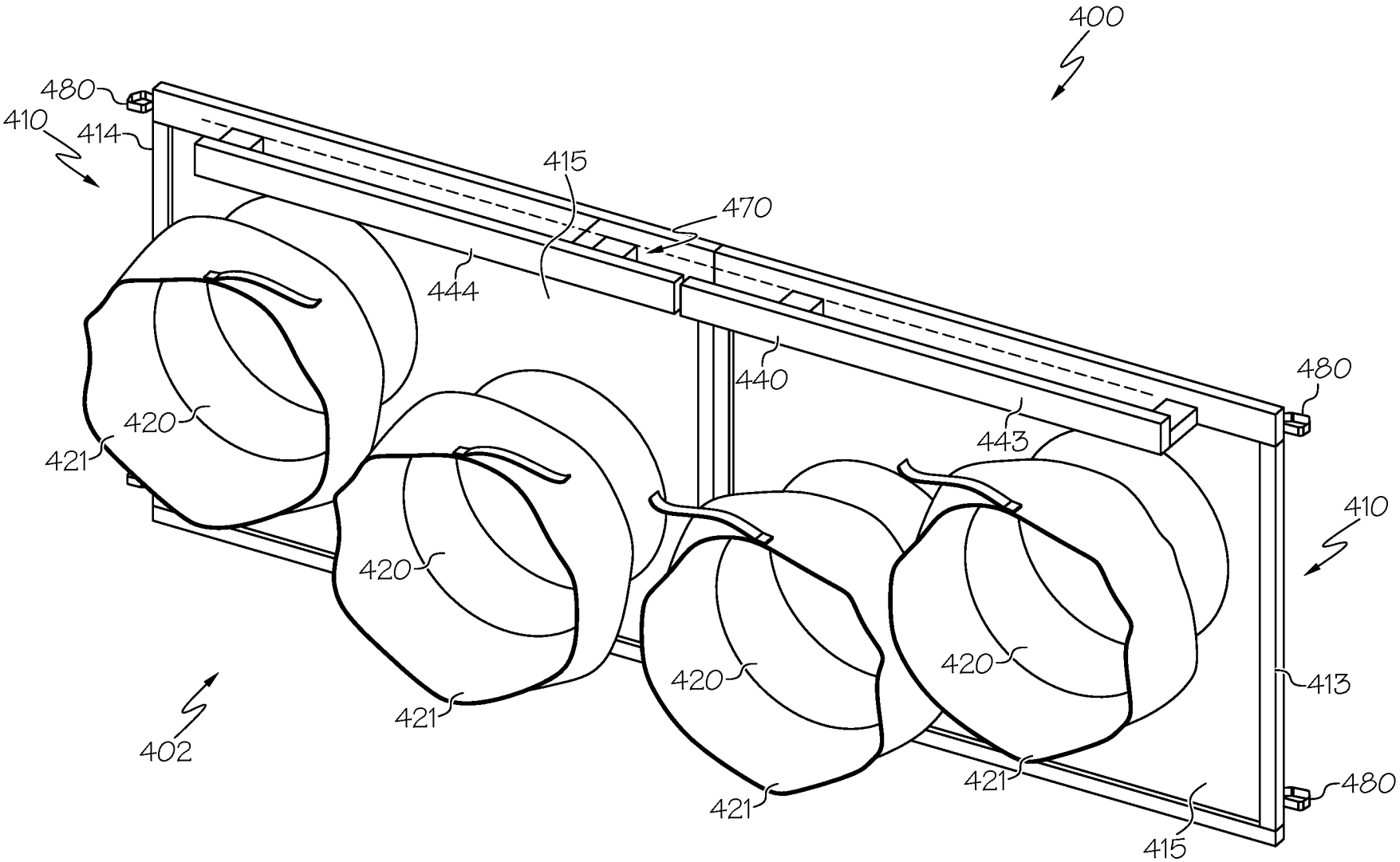
FIG. 5 depicts an exterior side of the interchangeable duct seal of FIG. 4 in accordance with embodiments of the invention.

An interior side 401 of the interchangeable duct seal 400 is shown in FIG. 4 while an exterior side 402 of the interchangeable duct seal 400 is shown in FIG. 5. It will be understood that the interior side 401 and the exterior side 402 are designated for convenience in understanding the Figures and are not intended to limit the scope of the subject matter. For example, it will be understood that features shown with respect to the interior side 401 of the interchangeable duct seal 400 may apply additionally or alternatively to the exterior side 402 of the interchangeable duct seal and vice versa.

Referring to FIG. 4, the interchangeable duct seal 400 comprises one or more panels, for example, a first panel 410 and second panel 411 as shown. The first panel 410 and the second panel 411 may generally comprise a rectangular shape defined by a support structure, such as a first support structure 413 and a second support structure 414 as shown in FIG. 1. Like the first support structure 113 and the second support structure 114, the first support structure 413 and the second support structure 414 may be made of a rigid or semi-rigid material, for example, metal, wood, plastic, composite, and the like. In some embodiments, aluminum or other material having a high strength to weight ratio may be chosen. The support structures may comprise or be referred to as a frame for example. In further embodiments, a thermoformed material may be used, for example, a thermoformed plastic, a thermoformed sheet, or the like. In these embodiments, the support structures may comprise or be referred to as a seal, a seal structure, and the like.

The support structure such as the first support structure 413 and/or the second support structure 414 may seal or substantially seal the entryway. For example, airflow through the entryway may be prevented or substantially prevented, particularly airflow around the panel. Still further, the support structure may ensure that the entryway remains open, for example, preventing a door from closing.

In some embodiments, other shapes may be used for the first panel 410, the second panel 411, and/or additional panels. The first panel 410 and/or the second panel 411 comprise a material 415 (similar or identical to material 115) within the first support structure 413 and/or the second support structure 414. The material 415 provides a barrier that substantially prevents passage of air. For example, the material 415 may be formed of fabric material, a plastic material, a composite material, and the like. The material 415 may be synthetic, natural, or a mix thereof. In embodiments, the material 415 may be the same in the first panel 410 and the second panel 411; however, this is not required and different materials may be used, for example a first material in the first panel 410 and a second material in the second panel 411.

Further, one or more of the first panel 410, the second panel 411, and/or additional panels comprise an opening 420 in the material 415. The opening 420 may be configured to receive a duct 430 and/or an end of the duct 430 as shown for example, in FIG. 7. In the embodiment shown, each panel includes two openings 420. It will be understood that each panel could alternatively include only one opening 420 or could include more than two openings 420. In some embodiments, the opening 420 may include a protrusion extending from the opening 420 on the interior side 401 such as the protrusion 125 discussed above. The protrusion may help maintain proper sealing around the duct or facilitate attachment of the duct 430. Alternatively, the opening 420 may include features that allow for connection or mating of the duct 430 as described in more detail below.

Similar to the opening 120 discussed above, the opening 420 may provide passage of air through the first panel 410 or second panel 411 and thus through the interchangeable duct seal 400. Air may be provided to the building or structure (intake) or may be removed from the building or structure (exhaust). Further, in embodiments using multiple openings 420, the interchangeable duct seal 400 may provide for both intake and exhaust. It will be understood that any type of air or fluid may be provided, either as intake or exhaust. For example, the interchangeable duct seal may be used to provide temperature control, humidity control, air conditioning, heating, cooling, and the like. Still further, chemicals, fumes, smoke, and the like may be removed by exhausting air through the interchangeable duct seal 400 and/or providing fresh air intake through the interchangeable duct seal 400. In the depicted embodiments, more than two ducts 430 are included—multiple ducts 430 may be used for intake and/or multiple ducts may be used for exhaust.

Figure 7:
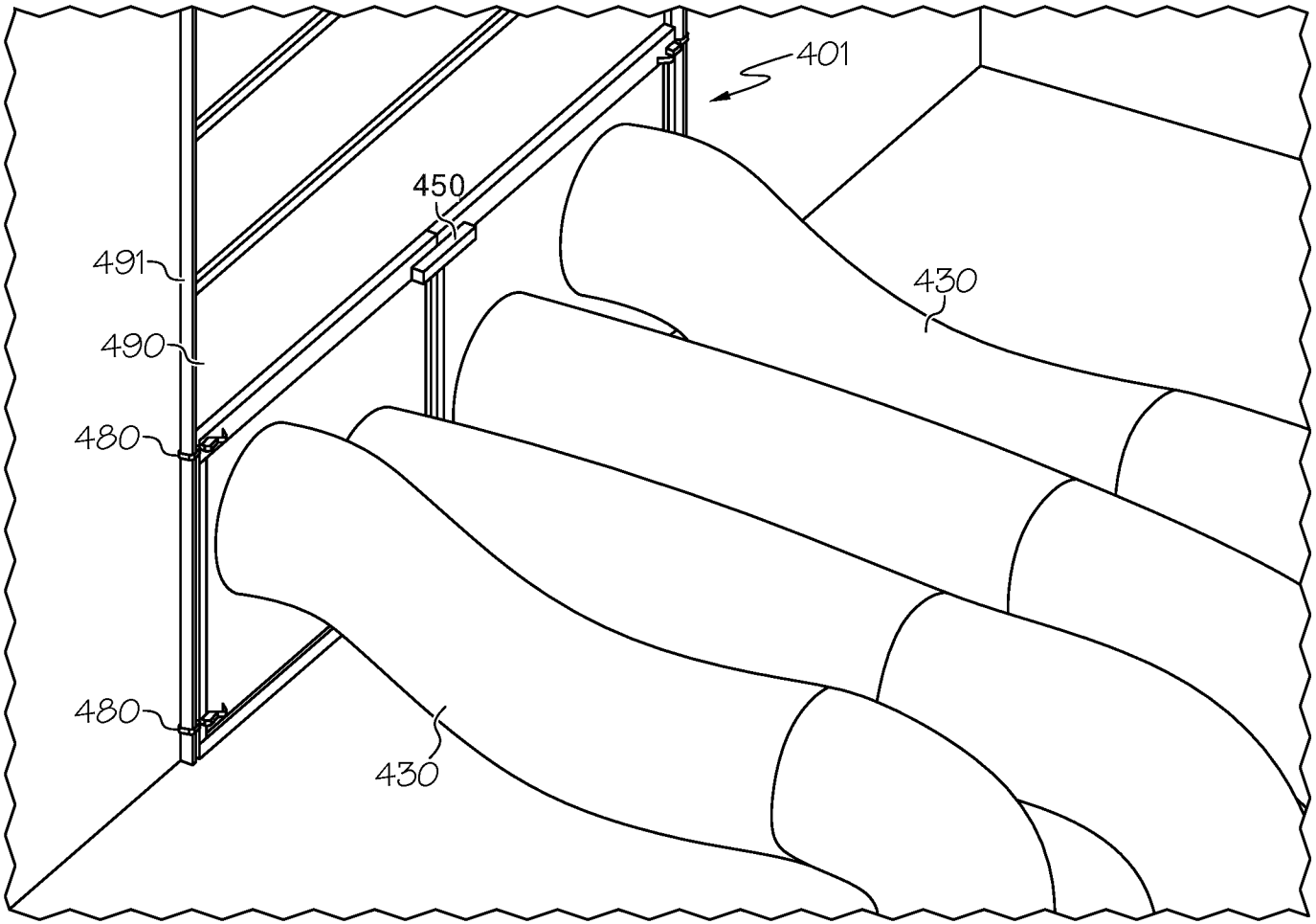
FIG. 7 depicts an interior side of the interchangeable duct seal of FIGS. 4-6 in use with a dock door in accordance with embodiments of the invention.

In embodiments, the duct 430 may be similar to or identical to the duct 130. Thus, as discussed above, the duct 430 conventional duct and/or may be a flexible duct with interchangeable end, as described in Applicant's prior disclosure in U.S. application Ser. No. 15/922,225, filed on Mar. 15, 2018, now U.S. Pat. No. 11,131,477, issued on Sep. 28, 2021, incorporated by reference above. As shown in FIG. 7, the duct 430 may pass through the first panel 410 or second panel 411 by passing through the respective opening 420 in the material 415. Alternatively, the end of the duct 430 may connect to or mate with the panel 415 as is discussed in more detail below.

Figure 9:
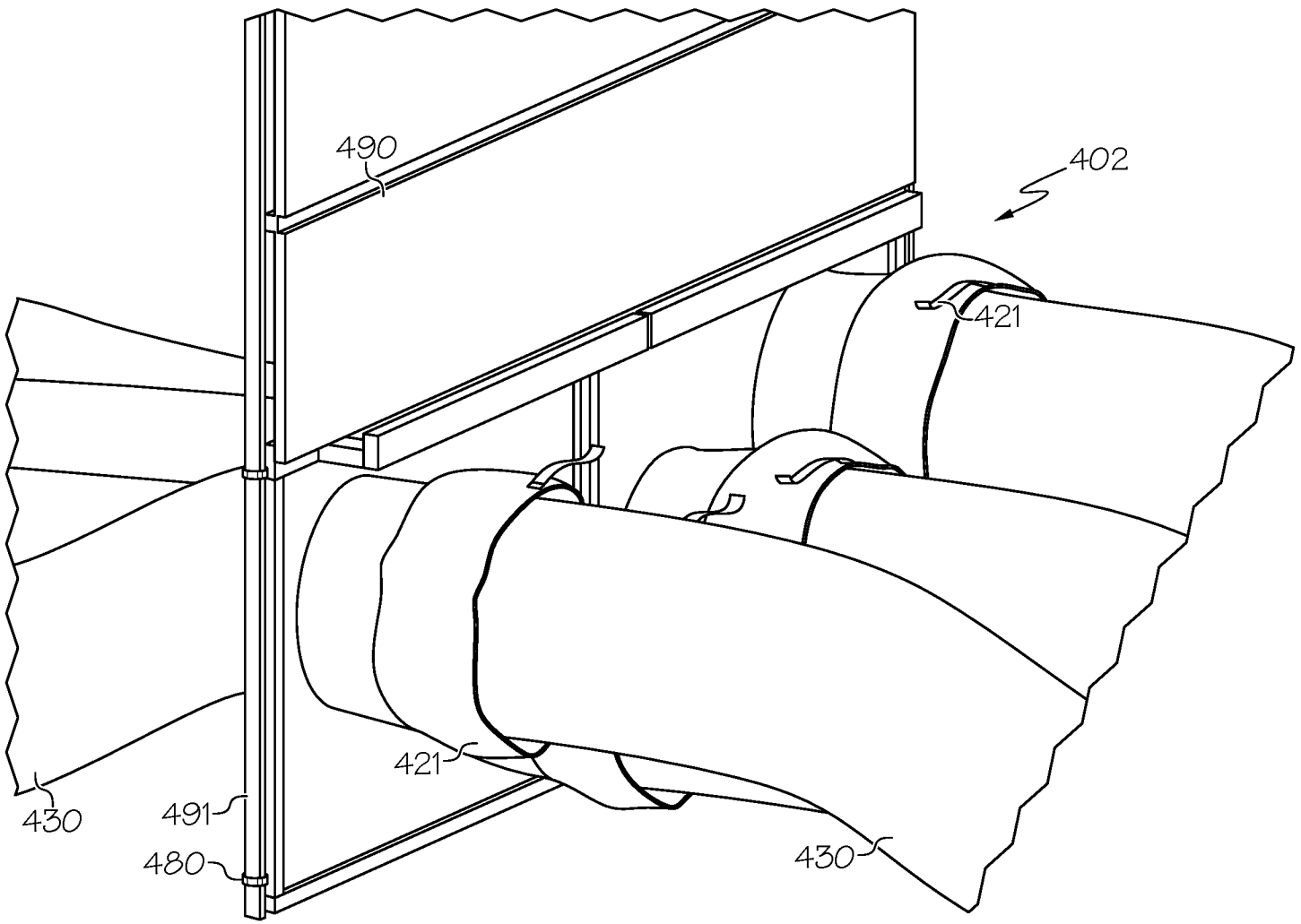
FIG. 9 depicts a partially cut away exterior side of the interchangeable duct seal of FIGS. 7-8 in use with the dock door in accordance with embodiments of the invention.

Referring now to FIG. 5, the openings 420 in the material 415 may include a cuff connector 421 on the exterior side 402. Like the cuff connector 121, the cuff connector 421 may help maintain proper sealing around the duct 430 or facilitate attachment of the duct 430. As discussed above with respect to the cuff connector 121, the cuff connector 421 may comprise, or be similar to, a connector such as that discussed in Applicant's prior disclosure in U.S. application Ser. No. 15/922,225, filed on Mar. 15, 2018, now U.S. Pat. No. 11,131,477, issued on Sep. 28, 2021, incorporated by reference above. For example, the cuff connector 421 may comprise or be similar to a connector such as that shown in FIG. 21 of U.S. Pat. No. 11,131,477 or may include features thereof, including but not limited to a first attachment and a second attachment. For example, the cuff connector 421 may have multiple attachment means for securing a duct end thereto. For example, each cuff connector 421 may include a rigid hoop attachment as well as a strap and buckle attachment. In this way, the cuff connector 421 may be attached to an end of a duct 430 by the strap and buckle attachment or by the rigid hoop attachment. Additional or alternative types of attachment may be used in some embodiments, for example the first attachment and/or the second attachment may include a cinch closure attachment or other attachment. The first attachment and the second attachment can be used independently of each other. For example, the rigid hoop attachment may be used by folding the cuff connector 421 backwards into itself to position the rigid hoop attachment at an end of the cuff connector 421. Referring still to FIG. 5, each of the openings 420 is shown with a cuff connector 421 configured with the strap and buckle attachment unrolled for use. Likewise, FIG. 9 shows the cuff connectors 421 configured to use the strap and buckle attachment.

At times, the cuff connector 421 may not be connected to a duct and/or may not be in use. The cuff connector 421 may be closed, for example, may be cinched closed or may be closed using an additional closing feature. Thus, the cuff connector 421 may block or prohibit air flow through the respective opening 420.

It will be understood that the cuff connector 421 could alternatively be positioned on the interior side 401 of the interchangeable duct seal 400 in some embodiments. Still further, in some embodiments, the interchangeable duct seal 400 may have a cuff connector 421 on both the interior side 401 and the exterior side 402, either as part of different openings 420 or as part of the same opening 420. Still further, in some embodiments, the interchangeable duct seal 400 may have a cuff connector 421 on both the interior side 401 and the exterior side 402, either as part of different openings 420 or as part of the same opening 420 and/or may have a protrusion on both the interior side 401 and the exterior side 402, either as part of different openings 420 or as part of the same opening 420.

In still further embodiments, one or both of the interior side 401 and the exterior side 402 may include additional or alterative features that allow for connection or mating of the duct 430. For example, the protrusion or a different feature proximate the opening 420 may be configured as an attachment point for a connector and/or for a flexible duct with interchangeable end such as those discussed in Applicant's prior disclosure in U.S. application Ser. No. 15/922,225, filed on Mar. 15, 2018, now U.S. Pat. No. 11,131,477, issued on Sep. 28, 2021, incorporated by reference above. Likewise, the protrusion or a different feature proximate the opening 420 may be configured as an attachment point for other conventional duct connecting/attaching means.

In embodiments, the protrusion, cuff connector 421, or other features may be integrally formed with the material 415. Alternatively, the protrusion, cuff connector 421, or other features may be attached to the material 415, for example, by sewing, stitching, gluing, taping, welding, brazing, clamping, etc. or by using cleats, clips, etc.

Figure 6:
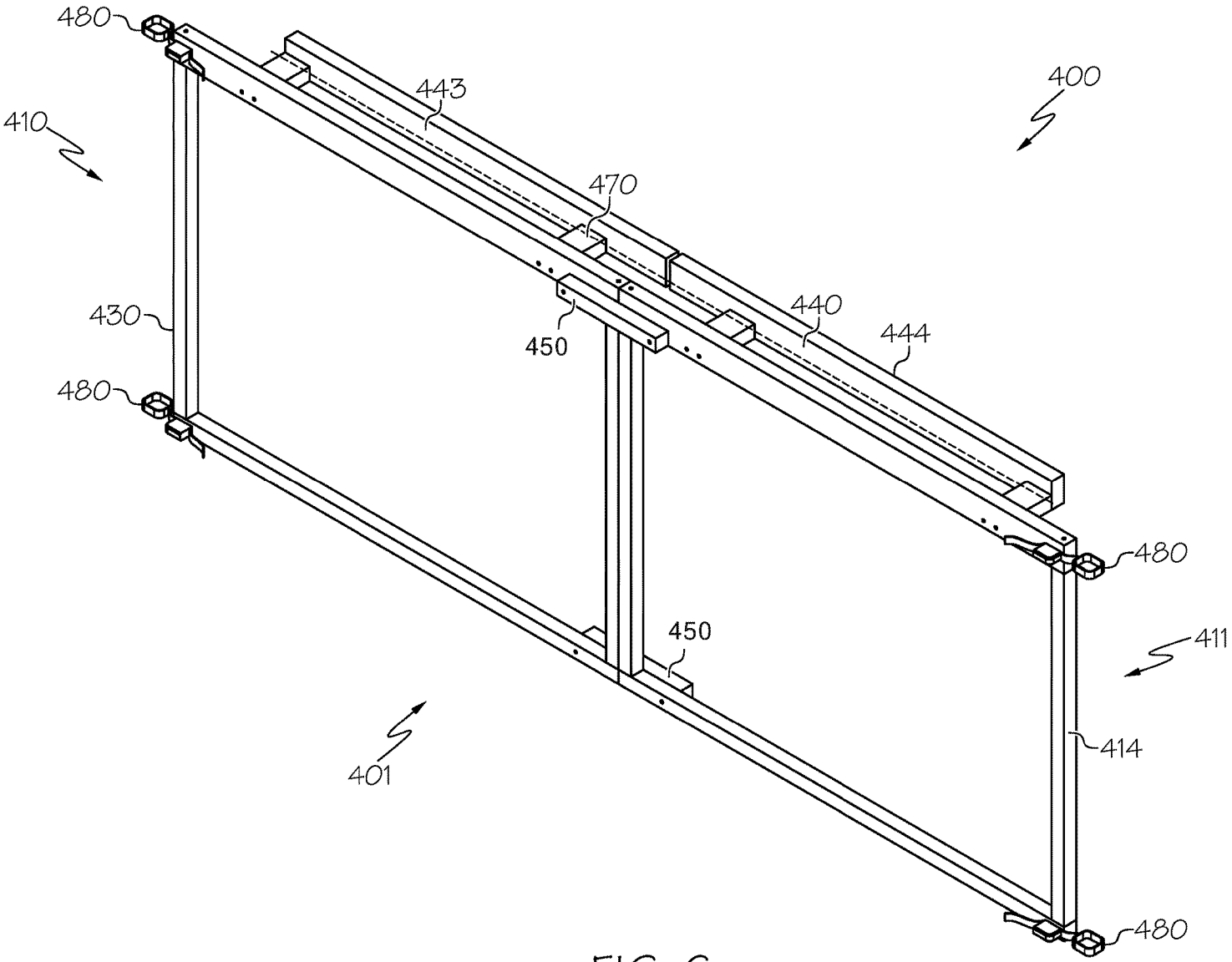
FIG. 6 depicts an interior side of the interchangeable duct seal of FIGS. 4 and 5 specifically showing support structures of the interchangeable duct seal in accordance with embodiments of the invention.

In the case of a two-panel interchangeable duct seal such as that depicted in FIGS. 4-6, the first panel 410 may be detachably attached to the second panel 411. In the embodiments depicted in FIGS. 4-6, the first panel 410 is connected to the second panel 411 by a connection 450. More specifically, as depicted the first support structure 413 may be connected to the second support structure 414 by the connection 450.

In embodiments, the connection 450 may be a bracket as discussed above with respect to the connection 150 for example a bolt-on bracket or similar device. The connection 450 may extend to, or otherwise span, two panels and/or two support structures, and be bolted onto each respective panel or support structure. Thus, a bolted connection between respective panels/support structures may be achieved. Other connection means may also be used, for example, connections using screws, nails, and other types of fasteners.

The connection 450 may allow the interchangeable duct seal 400 to be deployed in several different, interchangeable configurations, for example, by the first panel 410 fitted to and sealing a smaller entryway, by the first panel 410 and second panel 411 connected to each other and fitted to and sealing an entryway such as a dock door entryway 490 depicted in FIGS. 7-12, or by multiple connected panels fitted to and sealing an even larger entryway.

As with the earlier embodiments, the connection 450 may be hinged. When the connection 450 is a hinged connection, the hinged connection 450 may allow the interchangeable duct seal 400 to be optionally folded in half.

As discussed above with respect to the first panel 110 and the second panel 111, the first panel 410 and the second panel 411 may be substantially identical or may be different. For example, the panels may comprise support structures of different material, material 415 may be different, the openings 420 may be different, etc. Still further, in some embodiments, the panels 410 and 411 may be configured to be corresponding left and right panels, for example, as shown in FIGS. 4-6, the brace 440 is formed from a first brace portion 443 and second brace portion 444, such that the first panel 410 is a substantially mirror image of the second panel 411 and the first brace portion 443 and the second brace portion 444 are offset from a side edge of the panel and substantially aligned at the center of the interchangeable duct seal 400. Again, this is not required, and the first panel 410 and second panel 411 could be identical or substantially identical such that either panel could be a respective left or right panel.

Figure 13:
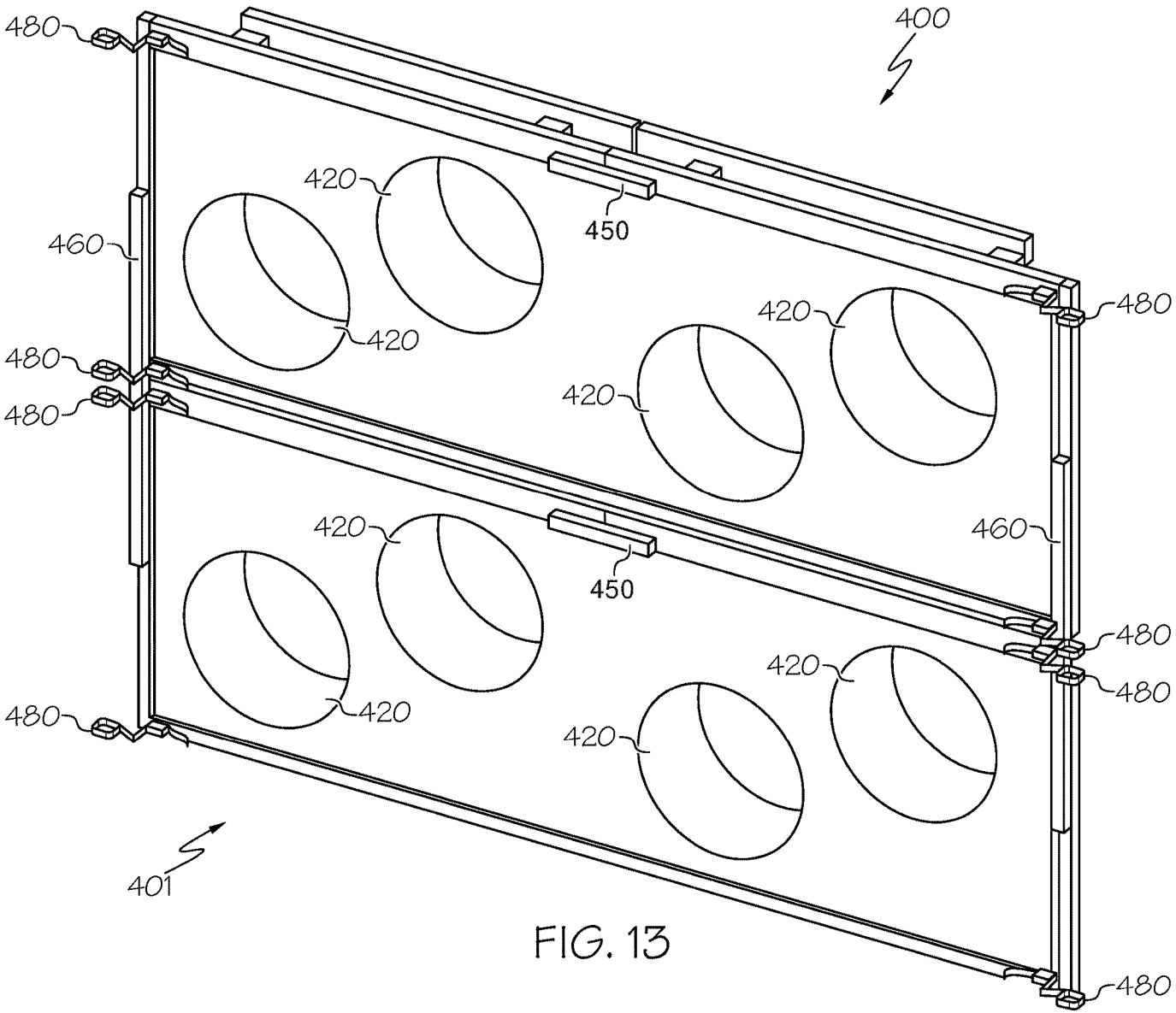
FIG. 13 depicts an interior view of two interchangeable duct seals used together in accordance with embodiments of the invention.
Figure 14:
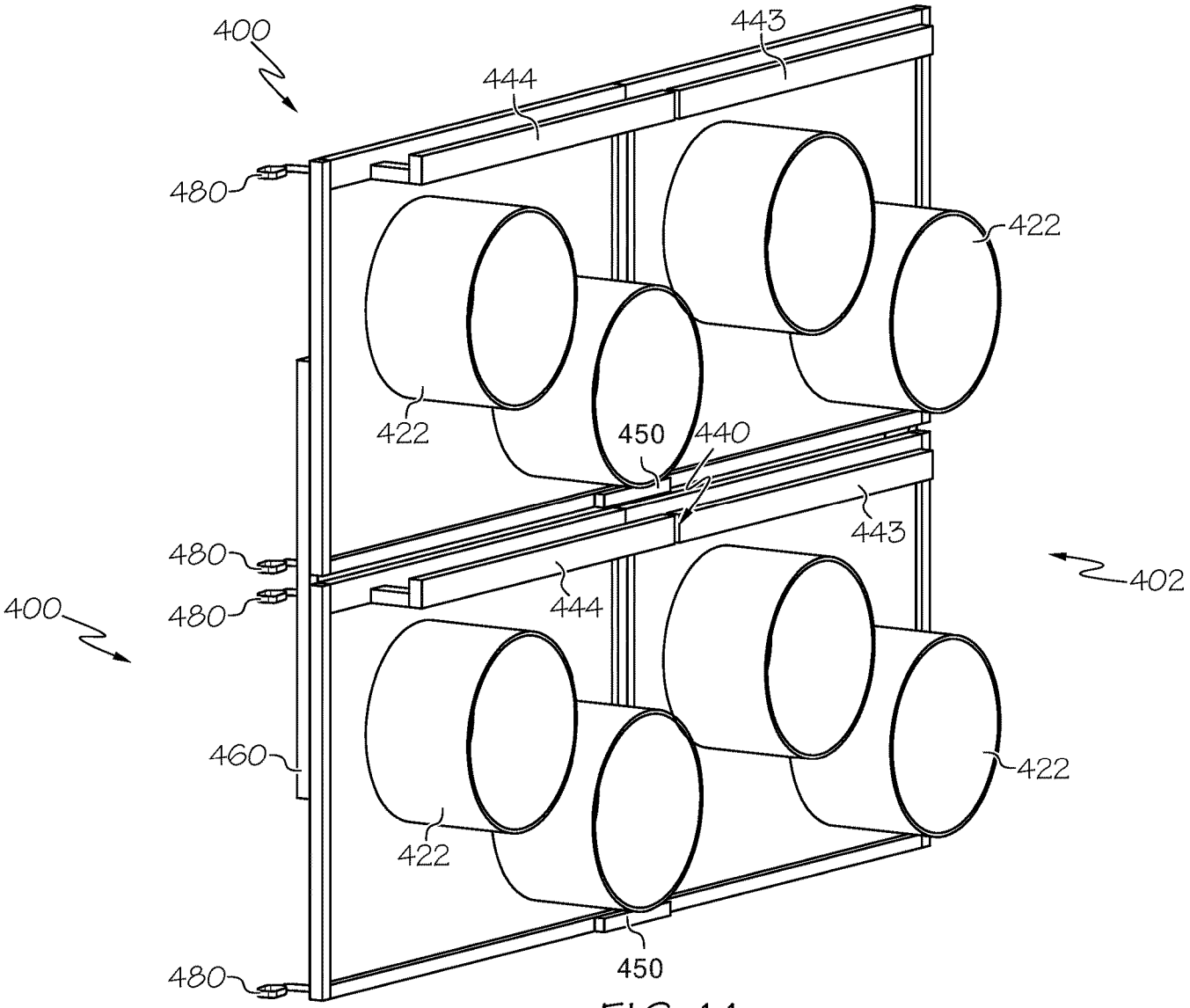
FIG. 14 depicts an exterior view of the two interchangeable duct seals used together of FIG. 13 in accordance with embodiments of the invention.

As discussed in more detail below, any number of panels may be connected to each other, either vertically, horizontally or a combination thereof. For example, two or more panels may be stacked vertically as shown in FIGS. 13 and 14. Still further, one or both of the two panels may also be connected horizontally to a further panel. Thus, as an example, a 2 by 2 arrangement of panels may be formed. It will be understood that any number of additional panels may be so connected, and that uniform numbers of panels would not be required for the vertical and horizontal panels. For example, 2 vertical panels may be used, with one or both of the vertical panels connected horizontally to a single additional panel. Again, any number of panels may be connected in any orientation or arrangement. The use of detachable panels and/or folding panels may allow for more convenient transport, installation, and removal as well as adaptability to a wide variety of existing structures.

With reference again to FIGS. 4-6, the interchangeable duct seal 400 comprises a brace 440. In the depicted embodiment, the brace 440 includes a first brace portion 443 proximate to the first support structure 413 and a second brace portion 444 proximate to the second support structure 414. The brace 440, for example, the first brace portion 443 and the second brace portion 444, may be positioned to be spaced from the first support structure 413 and the second support structure 414, respectively, by a channel 470.

The embodiments depicted in FIGS. 4-6 may be particularly well-suited for use with a dock door or similar entryway. For example, the channel 470 may be configured to receive a dock door 490 as shown in FIGS. 7-12. The dock door 490 may be a conventional door used on a loading dock or similar delivery area. For example, in the depicted embodiments, the dock door 490 may be a conventional rolling or roll-up door. Turning back to the brace 440 and the channel 470, the channel 440 may be configured to receive the dock door 490, for example, by having the dock door 490 rolled down on the interchangeable duct seal 400 when the interchangeable duct seal 400 is positioned in the dock door entryway, for example, as shown in FIGS. 7-12. The weight of the dock door 490 may serve to hold the interchangeable duct seal 400 in place. Alternatively or additionally, the dock door 490 may latch or otherwise connect to the interchangeable duct seal 400.

The brace 440 may also be configured for tightening onto the dock door 490 in some embodiments, for example, by sliding toward the support structure/panel. Still further, threaded rods and/or and corresponding holes may be used as discussed for earlier embodiments. When threaded rods and/or corresponding holes are used, they may be positioned in the brace 440 and respective panel/support structure such that they are positioned under the dock door 490 when the dock door 490 is in the channel 470. Alternatively, the dock door 490 could be configured to also have corresponding holes to connect the brace 440 to the dock door 490. Other embodiments for tightening the brace 440 and/or for holding the interchangeable duct seal 400 may also be used.

Figure 8:
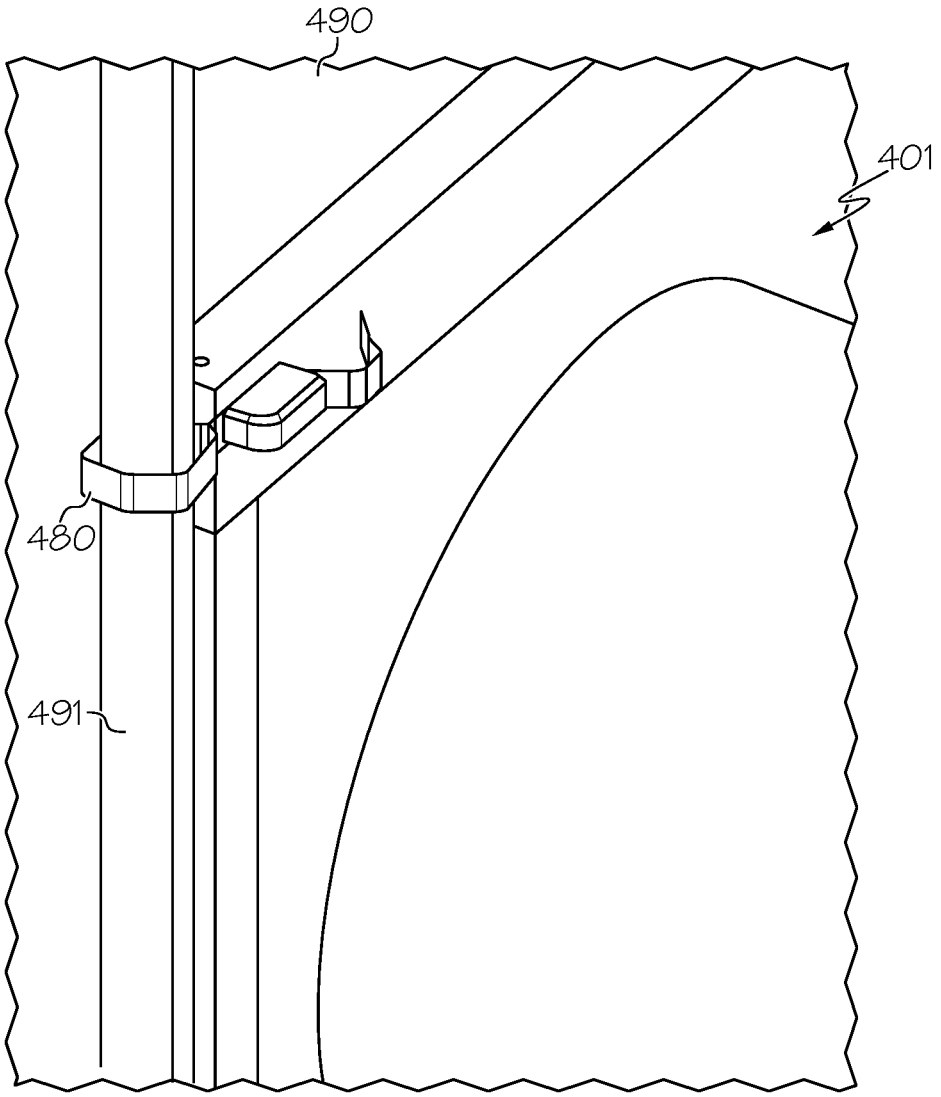
FIG. 8 depicts a close up view of a connection between the interchangeable duct seal and the dock door from FIG. 7 in accordance with embodiments of the invention.

Referring specifically to FIGS. 7-9, the rolling/roll-up type of dock door 490 may roll along a dock door rail 491, sometimes referred to as a dock door track. In some embodiments, the dock door 490 may include two corresponding dock door rails 491, for example, one on each side of the dock door 490. The dock door rail 491 may serve as an attachment point for the interchangeable duct seal 400 (separately or in addition to the brace 440 discussed above). For example, the interchangeable duct seal 400 may comprise rail straps 480 for attaching the interchangeable duct seal 400 to the dock door rail 491. Various materials and/or types may be used for the rail straps 480. Further, the rail straps 480 may be adjustable or variable, or otherwise capable of being tightened onto the dock door rail 491 to secure the interchangeable duct seal 400. A close up view of the rail straps 480 in use to attach the interchangeable duct seal 400 to the dock door rail 491 is shown in FIG. 8. It will be understood that multiple rail straps 480 may be used and may be positioned as needed. For example, a rail strap 480 may be provided on each side of the interchangeable duct seal 400, on each corner of the interchangeable duct seal 400, and/or at multiple places along or around the interchangeable duct seal 400. Again, the rail straps 480 may be used to secure the interchangeable duct seal 400 to the dock door entryway as an alternative or an additional attachment to the brace 440 and channel 470 discussed above.

Figure 10:
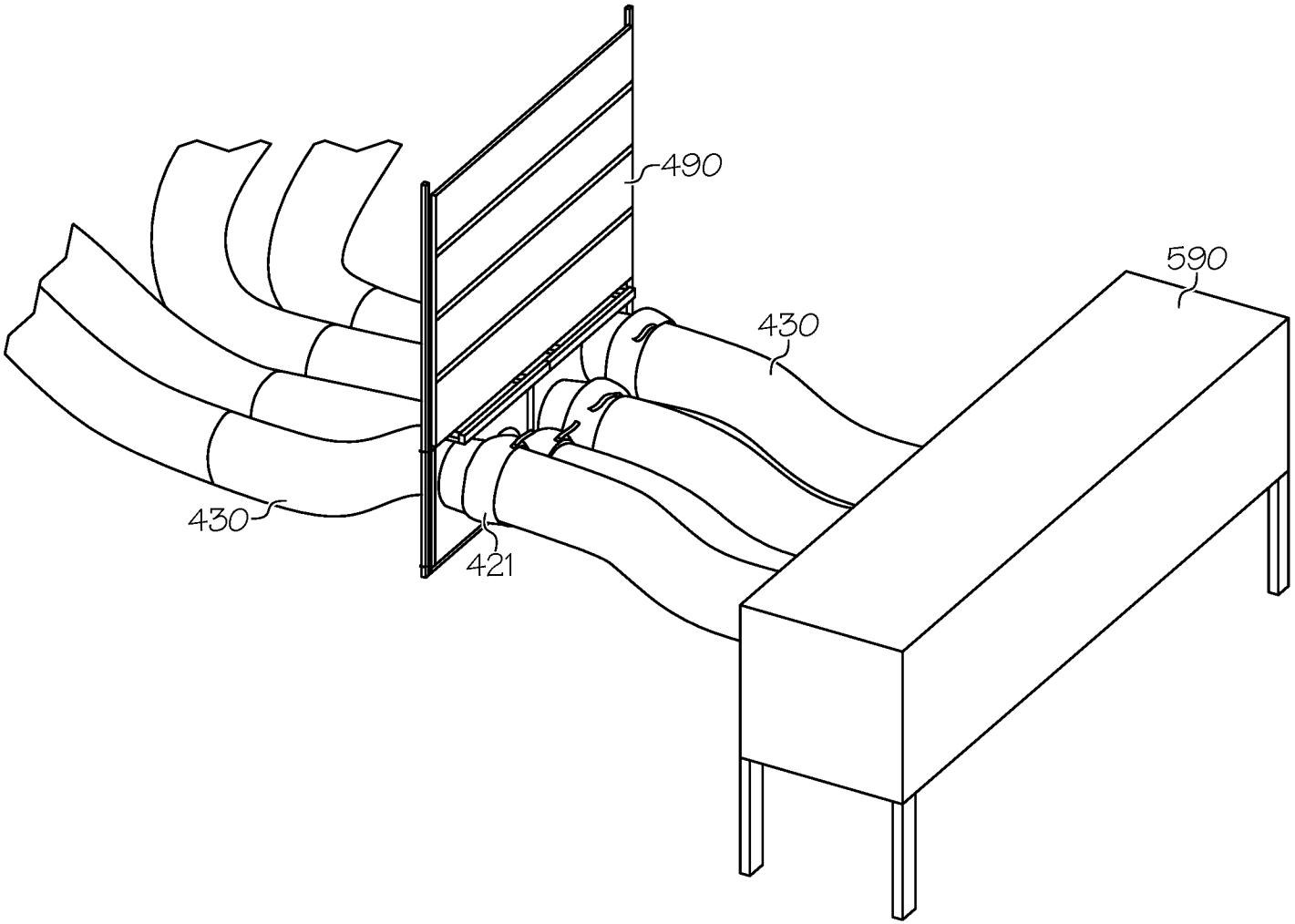
FIG. 10 depicts a partially cut away exterior view of the interchangeable duct seal of FIGS. 7-9 in use with the dock door and an industrial unit in accordance with embodiments of the invention.
Figure 11:
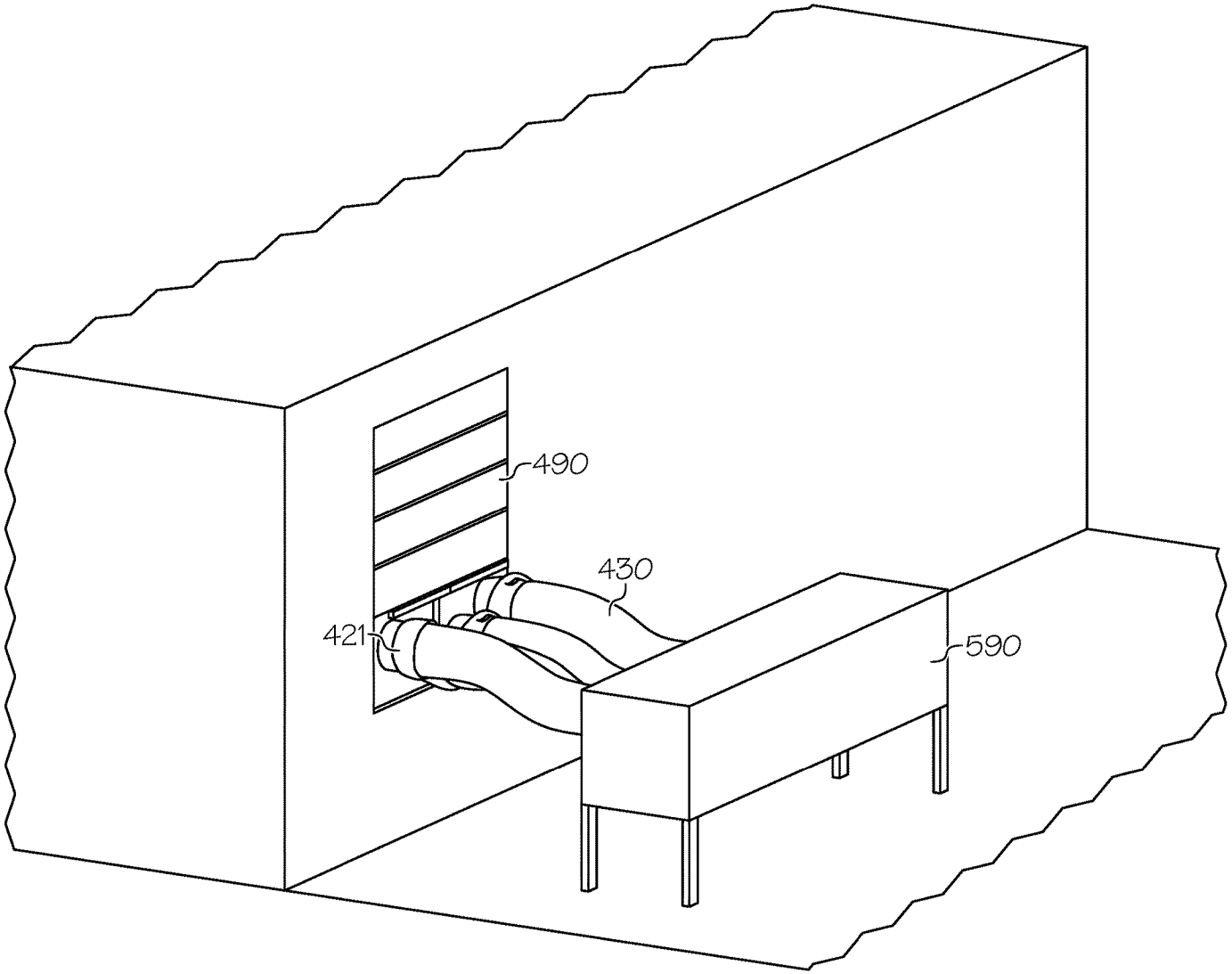
FIG. 11 depicts another exterior view of the interchangeable duct seal of FIG. 10 in use with the dock door and an industrial unit in accordance with embodiments of the invention.
Figure 12:
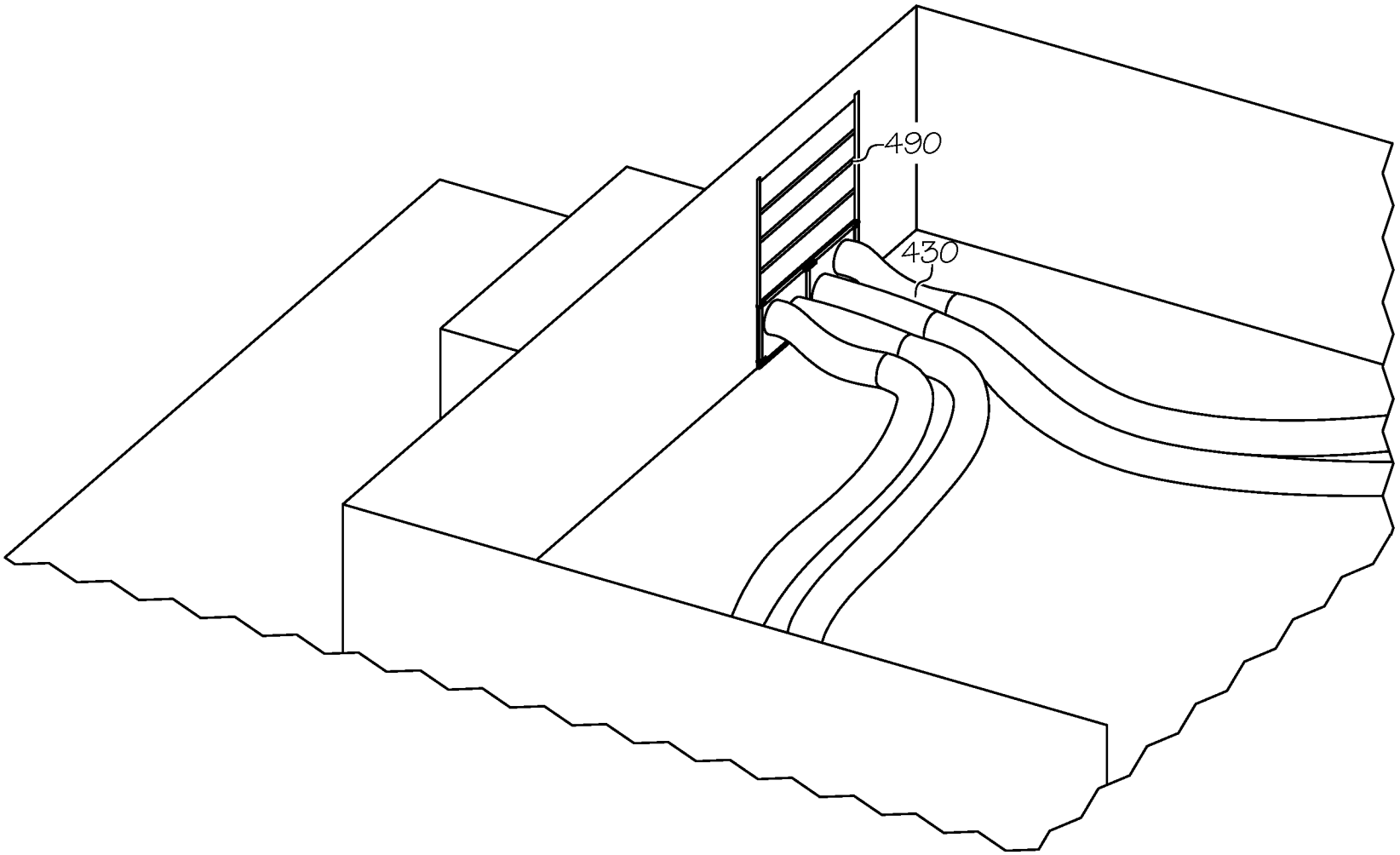
FIG. 12 depicts an interior view of the interchangeable duct seal of FIGS. 10-11 in use with the dock door and the industrial unit in accordance with embodiments of the invention.

With reference now to FIGS. 7-9, ducts 430 may pass through, connect to, or mate with the interchangeable duct seal 400 as has been discussed. Again, ducts and/or connectors such as those described in Applicant's prior disclosure in U.S. application Ser. No. 15/922,225, filed on Mar. 15, 2018, now U.S. Pat. No. 11,131,477, issued on Sep. 28, 2021, incorporated by reference above, may be used. Alternatively or additionally, other types of ducts, connections, and/or mating systems may be used. FIG. 7 shows in interior space of the building, tent, or structure with ducts 430 passing through the interchangeable duct seal 400 in accordance with embodiments. FIG. 9 shows a partially cut-away exterior view. Still further, FIG. 10 shows an even more detailed cut away exterior view in which ducts 430 pass through the interchangeable duct seal 400 in use on a dock door 490. The ducts 430 further connect to or mate with an industrial unit 590, for example, a blower, fan, ventilating unit, or the like. FIG. 11 shows a similar view without the cut away. As can be seen, the dock door 490 and interchangeable duct seal 400 provide a substantially sealed connection between a building/structure and the industrial unit 590. FIG. 12 shows the connection of FIG. 11 from an interior of the building/structure.

FIGS. 13 and 14 depict an exemplary embodiment in which two interchangeable duct seals **400*a*/400*b* are attached vertically—i.e., four panels are arranged in a 2 by 2 arrangement. FIG. 13 shows an interior side 401 and FIG. 14 shows an exterior side 402. The interchangeable duct seals 400*a*/400*b* include the features previously described with respect to FIGS. 4-12; however, the openings are shown with protrusions 422 on the exterior side 402. As discussed above, the protrusions 422 may serve as attachment or mating points for a connector and/or a duct, for example, connectors and/or ducts such as those described in Applicant's prior disclosure in U.S. application Ser. No. 15/922,225, filed on Mar. 15, 2018, now U.S. Pat. No. 11,131,477, issued on Sep. 28, 2021, incorporated by reference above, or other conventional connectors/ducts. It will be understood that the arrangement of panels shown in FIGS. 13 and 14 could include the cuff connector 421 on some or all of the openings 420**.

As shown, the two interchangeable duct seals **400*a*/400*b* may be identical or substantially similar. For example, each interchangeable duct seal 400*a*/400*b* may include the brace 440 and the channel 470. However, it will be understood that in some embodiments only one of the interchangeable duct seals 400*a*/400*b* could be provided with the brace 440 and the channel 470. For example, in the depicted embodiment, only the upper interchangeable duct seal 400*a* would contact the dock door 490, and thus only the upper interchangeable duct seal 400*a* could be provided with the brace 440 and the channel 470**.

Still further, the number of openings 420 might be varied between the two interchangeable duct seals **400*a*/400*b*, the orientation/arrangement of the openings 420** might be varied, and/or the respective attachment or mating points might be varied.

FIGS. 13 and 14 also include an additional connection 460 used to connect the panels arranged vertically. More than one additional connections 460 may be used, as shown in FIG. 13. Further, while the additional connection 460 is shown on the interior side 401, it may alternatively be located on the exterior side 402. Still further, additional connections 460 may be provided on both the interior side 401 and the exterior side 402.

In some embodiments, the additional connection 460 may be a as discussed above with respect to the connections 150 and 450, for example, a bolt-on bracket or similar device. The additional connection 460 may extend to, or otherwise span, two panels and/or two support structures, and be bolted onto each respective panel or support structure. Thus, a bolted connection between respective panels/support structure may be achieved. Other connection means may also be used, for example, connections using screws, nails, and other types of fasteners.

Figure 15:
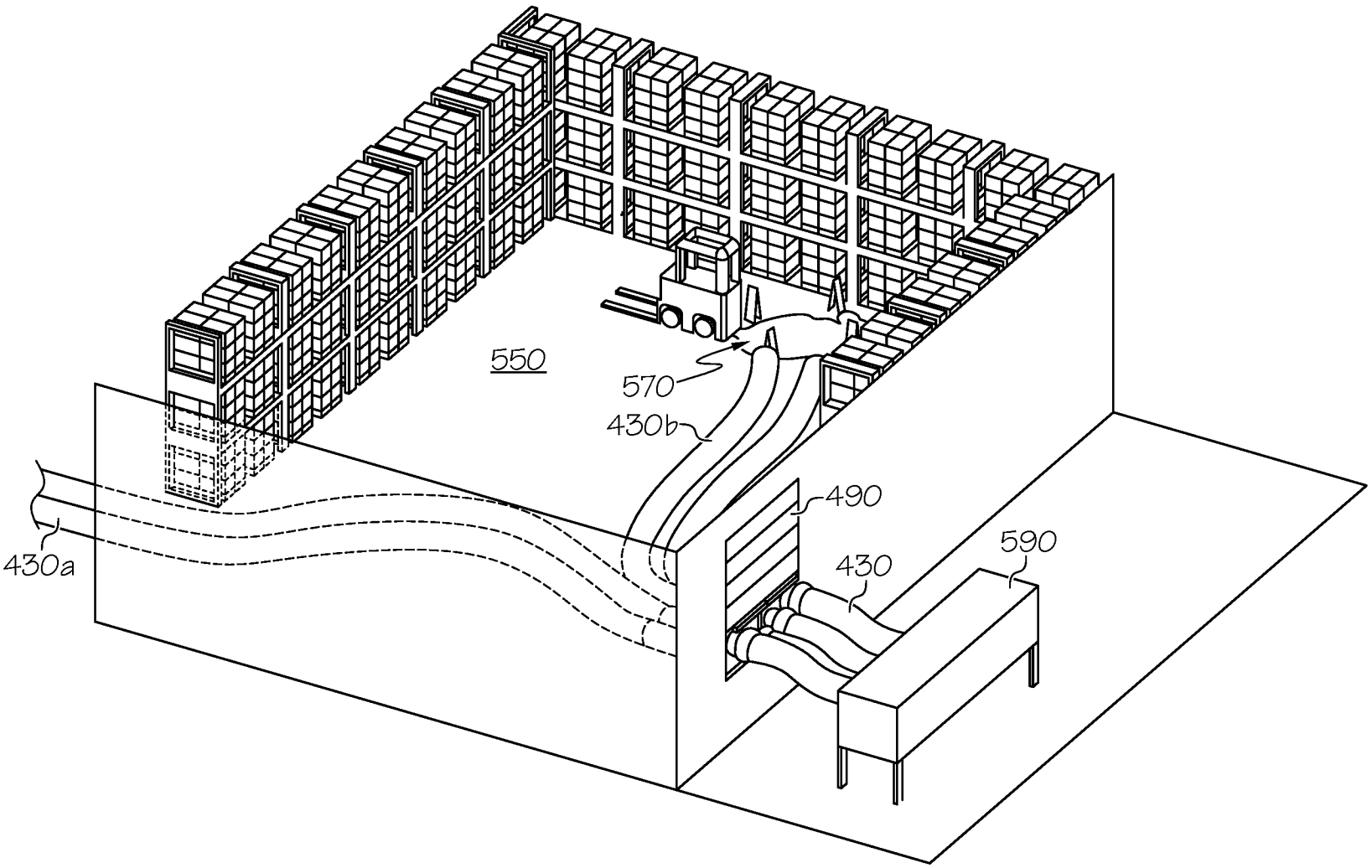
FIG. 15 depicts a view of the interchangeable duct seal of FIGS. 7-12 in use with the dock door and the industrial unit in accordance with embodiments of the invention.

FIG. 15 depicts an exemplary embodiment in which an interchangeable duct seal 400 is used to provide air intake and exhaust. For example, intake and exhaust may be provided simultaneously, substantially simultaneously, alternatively, etc. As shown, the interchangeable duct seal 400 may be positioned in a dock door 490 and connected to an industrial unit 590. In the depicted embodiment, a first set of ducts 430*a* are used to provide air intake through the dock door 490 and into an interior of a building or structure. As previously discussed, this air intake may comprise fresh air, temperature control, humidity control, air conditioning, heating, etc. A second set of ducts 430*b* are used to provide exhaust. For example, it may be desired that a warehouse or storage space 550 is to be vented. In the specifically depicted embodiment, an area around a spill 570 may be vented/exhausted. For example, the spill 570 may comprise a hazardous or toxic substance, chemicals, fumes, smoke, and the like. Air around the spill 570 may be removed through the second set of ducts 430*b*.

It will be understood that intake/exhaust functions could be provided by the first set of ducts 430*a*, the second set of ducts 430*b*, by both set of ducts, etc.

Still further, it will be understood that the intake/exhaust functions include embodiments not specifically described herein. For example, in alternative embodiments fresh air, temperature control, humidity control, air conditioning, heating, etc. may also be provided to the warehouse or storage space 550.

Referring broadly to the embodiments discussed herein, a variety of applications are possible. As an example, in the case of an emergency, a power outage, or other situations, a building or structure may need to maintain temperature control, humidity control, air conditioning, heating, etc., using temporary or supplemental ducting, for example, in order for the building or structure to properly function, to provide a habitable environment, to provide proper storage, for occupant comfort, etc. The embodiments herein could be deployed in various configurations to efficiently provide appropriate ducting.

Embodiments of the invention further include kits for providing an interchangeable duct seal.

In some embodiments, an interchangeable duct seal kit may be provided. The interchangeable duct seal kit may include one or more panels such as the first panel 110 and/or the second panel 111. It will be understood that the one or more panels may include one or more support structures such as the first support structure 113 and the second support structure 114 as well as one or more materials for the panels, for example, the material 115 or that the respective support structure and materials may be provided separately. The interchangeable duct seal kit may further include a brace, such as brace 140 and/or a connection such as connection 150. Still further, the interchangeable duct seal kit may include a cuff connector, such as cuff connector 121, and/or a duct.

A further embodiment of the interchangeable duct seal kit may include one or more panels such as the first panel 410 and/or the second panel 411. It will be understood that the one or more panels may include one or more support structures such as the first support structure 413 and the second support structure 414 as well as one or more materials for the panels, for example, the material 415 or that the respective support structure and materials may be provided separately. The interchangeable duct seal kit may further include a brace, such as brace 440 and/or a connection such as connection 450. In some embodiments, the interchangeable duct seal kit may further include one or more rail straps such as rail straps 480. Still further, the interchangeable duct seal kit may include a cuff connector such as cuff connector 421 and/or a duct. Moreover, the interchangeable duct seal kit may include a further connection such as further connection 460.

It will be understood that embodiments and features described with respect to the interchangeable duct seal 100, 400 and embodiments thereof, may also apply or be applied to the interchangeable duct seal kits and embodiments thereof, and vice versa.

In embodiments, a method of providing ducting to a structure is provided. In general, the method may comprise providing an interchangeable duct seal, such as the interchangeable duct seal 100 and/or the interchangeable duct seal 400, positioning the interchangeable duct seal in an entryway to the structure, and connecting a duct to the interchangeable duct seal and/or passing the duct through the interchangeable duct seal.

In more detail, a first method may include providing one or more panels such as the first panel 110 and/or the second panel 111. It will be understood that the one or more panels may include one or more support structures such as the first support structure 113 and the second support structure 114 as well as one or more materials for the panels, or the respective support structure and materials may be provided separately. Likewise, the first panel 110 and/or the second panel 411 may include a cuff connector such as cuff connector 121 or the respective cuff connector may be provided separately. The first method may further comprise providing a brace, such as brace 140 and/or a connection such as connection 150. The first method may include positioning the one or more panels in an entryway and securing the one or more panels to or in the entryway using the brace. Still further, the first method may include connecting a duct and/or allowing the duct to pass through the panel(s). In embodiments, the first method may include providing flow of a fluid through the duct, for example, providing an airflow through the duct. In some embodiments, an intake and/or an exhaust may be provided, for example, simultaneously, substantially simultaneously, or alternatively. The first method may include an optional step of connecting panels of the one or more panels together using the connection.

A second method may include providing one or more panels such as the first panel 410 and/or the second panel 411. It will be understood that the one or more panels may include one or more support structures such as the first support structure 413 and the second support structure 414 as well as one or more materials for the panels, or the respective support structures and materials may be provided separately. Likewise, the first panel 410 and/or the second panel 411 may include a cuff connector such as cuff connector 421 or the respective cuff connector may be provided separately. The second method may further comprise providing a brace, such as brace 440 and/or a connection such as connection 450. The first method may include positioning the one or more panels in an entryway and securing the one or more panels to or in the entryway using the brace. For example, securing the panels may include receiving a dock door, such as dock door 490, in a channel of the brace, such as channel 470 of brace 440. Still further, the second method may include connecting a duct and/or allowing the duct to pass through the panel(s). In embodiments, the second method may include providing flow of a fluid through the duct, for example, providing an airflow through the duct. In some embodiments, an intake and/or an exhaust may be provided, for example, simultaneously, substantially simultaneously, or alternatively. The second method may include an optional step of connecting panels of the one or more panels together using the connection. Still further, the second method may include an optional step of providing a rail strap such as rail strap 480. In some embodiments, securing the one or more panels to or in the entryway may include attaching the rail straps to a dock door rail such as dock door rail 491.

It will be understood that embodiments and features described with respect to the interchangeable duct seal 100, 400 and embodiments thereof, as well as the interchangeable duct seal kits and embodiments thereof, may also apply or be applied to the methods discussed herein, and vice versa.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An interchangeable duct seal, comprising:

a first panel, the first panel having a first support structure and a first material attached to the first support structure;

a second panel, the second panel having a second support structure and a second material attached to the second support structure; and a brace configured for securing the first panel and/or the second panel to a dock door entryway, wherein the brace includes a channel configured to receive a dock door;

wherein the first panel and the second panel are connected by a connection; and wherein the first panel and/or the second panel include an opening and is configured to connect to a duct and/or allow the duct to pass through the interchangeable duct seal.

2. The interchangeable duct seal as claimed in claim 1, wherein the first panel and/or the second panel includes a cuff connector having a first attachment means and a second attachment means.

3. The interchangeable duct seal as claimed in claim 2, wherein the first attachment means is a strap and buckle and wherein the second attachment means is a rigid hoop.

4. The interchangeable duct seal as claimed in claim 1, further comprising a rail strap configured for attaching to a dock door rail.

5. The interchangeable duct seal as claimed in claim 1, further comprising a third panel, the third panel having a third support structure and a third material attached to the third support structure and a fourth panel, the fourth panel having a fourth support structure and a fourth material attached to the fourth support structure.

6. The interchangeable duct seal as claimed in claim 1, wherein the first panel includes a first opening used to provide air intake to the structure and the second panel includes a second opening used to exhaust air from the structure.

7. A method of providing ducting for an entryway of a building or tent, comprising:

positioning a first panel proximate the entryway, wherein the first panel includes a first support structure and a first material attached to the first support structure;

securing the first panel to the entryway using a brace such that the first panel seals the entryway; and connecting a first duct to the first panel and/or passing a first duct through the first panel, wherein the brace includes a channel configured to receive a dock door.

8. The method as claimed in claim 7, further comprising:

positioning a second panel proximate the entryway, wherein the second panel includes a second support structure and a second material attached to the second support structure; and securing the first panel or securing the first panel and the second panel to the entryway using the brace.

9. The method as claimed in claim 7, further comprising:

connecting a second duct to the second panel and/or passing the second duct through the second panel;

wherein the first duct can be used to provide air intake to the structure and/or the second duct can be used to exhaust air from the structure.

10. The method as claimed in claim 7, wherein the first panel includes a cuff connector having a first attachment means and a second attachment means, wherein the first attachment means is a strap and buckle and wherein the second attachment means is a rigid hoop.

11. The method as claimed in claim 7, wherein the first panel includes a rail strap, and wherein securing the first panel to the structure includes attaching the rail strap to a dock door rail.

* * * * *